United States Patent [19]

Schaedla

[11] 3,942,138

[45] Mar. 2, 1976

[54] SHORT DEPTH HARDENED WAVEGUIDE LAUNCHER ASSEMBLY ELEMENT

[75] Inventor: William Hugh Schaedla, Medford Lakes, N.J.

[73] Assignee: The United States of America as represented by the Secretary of the Air Force, Washington, D.C.

[22] Filed: Feb. 4, 1974

[21] Appl. No.: 439,666

[52] U.S. Cl. ..... 333/21 R; 333/33; 343/784

[51] Int. Cl.[2] ..... H01P 5/08; H01P 5/02

[58] Field of Search ..... 333/21 R, 33, 97 R, 98 R, 333/35; 343/862, 864, 784

[56] References Cited

UNITED STATES PATENTS

| | | | |
|---|---|---|---|
| 2,501,335 | 3/1950 | Hunter | 333/35 |
| 2,642,494 | 6/1953 | Zaslavsky et al. | 333/21 R |
| 3,101,459 | 8/1963 | Overholser | 333/33 |
| 3,680,138 | 7/1972 | Wheeler | 343/784 |
| 3,758,886 | 9/1973 | Landry et al. | 333/21 R |
| 3,825,932 | 7/1974 | Hockham | 343/784 |

OTHER PUBLICATIONS

Silver; S., "Microwave Antenna Theory & Design," McGraw–Hill, 1949, pp. 383–387.

*Primary Examiner*—Alfred E. Smith
*Assistant Examiner*—Wm. H. Punter
*Attorney, Agent, or Firm*—Joseph E. Rusz; William Stepanishen

[57] ABSTRACT

A waveguide launcher apparatus for coupling a coaxial transmission line to a waveguide array antenna element. The waveguide launcher apparatus utilizes its short depth to achieve the desired match between the coaxial connector and free space. The launcher apparatus has an L shape which performs as a matching element and as an adaptor between the coax transmission line and wave guide sections.

7 Claims, 3 Drawing Figures

SHORT DEPTH HARDENED WAVEGUIDE LAUNCHER ASSEMBLY ELEMENT

BACKGROUND OF THE INVENTION

The present invention relates broadly to an electromagnetic wave transmission device and in particular to a waveguide launcher apparatus for coupling a coaxial transmission line to a waveguide array antenna element.

In coupling a hollow waveguide to a coaxial transmission line, it is desirable to convert the waveform from one most suitable for transmission in a coaxial line to a form suitable for propagation in a waveguide. Therefore, the wave in the coaxial line requires that it be converted to a form compatable with the geometry of the waveguide. In the prior art, many techniques for accomplishing this purpose have been proposed and built, and usually have accomplished their basic purpose, but most of them have involved undesirable bulk or complicated devices which have resulted in inefficient transmission. The present invention provides a waveguide launcher apparatus which overcomes the difficulties encountered in the past systems and provides an extremely simple and compact system for coupling a coaxial transmission line to a waveguide array antenna element.

SUMMARY OF THE INVENTION

The present invention utilizes an L-shaped coax waveguide launcher assembly for use in a rectangular waveguide. The waveguide launcher assembly utilizes its short depth to achieve a match between the coax connector and free space. This desired match is achieved by configuring the coax to waveguide launcher assembly as a matching element and as an adapter between the coax and waveguide sections.

It is one object of the invention, therefore, to provide an improved coax to waveguide launcher apparatus providing a transition between a coaxial transmission line and a waveguide which permits the longitudinal axis of the coaxial line to be aligned with the propagation axis of the waveguide.

It is another object of the invention to provide an improved coax to waveguide launcher apparatus utilizing simplified and compact construction.

It is still another object of the invention to provide an improved coax to waveguide launcher apparatus having short depth to achieve a desired match between the coax connector and free space.

These and other advantages, features and objects of the invention will become more apparent from the following description taken in connection with the illustrative embodiment in the accompanying drawings.

DESCRIPTION OF THE PREFERRED EMBODIMENT

Figure 1:
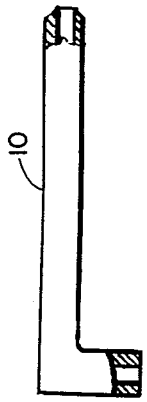
FIG. 1 is a plane view of the waveguide launcher apparatus in accordance with the present invention.
Figure 1A:
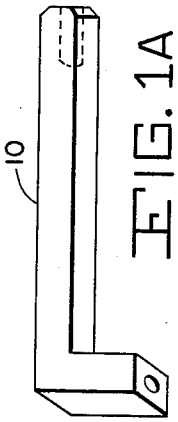
FIG. 1*a* is a perspective view of the waveguide launcher element of FIG. 1.

Referring now to FIG. 1, there is shown the waveguide launcher element 10 comprising two rectangular members which are joined at one end respectively to have a substantially L-shape. For example purposes only, the waveguide launcher element 10 will be described with respect to typical dimensions which provide the functions herein stated. However, it must be clearly understood that there is no intention to limit the scope of the present invention to these particular dimensions. The waveguide launcher element 10 has a drilled tapped hole at the end of the short member to facilitate the mounting of the waveguide launcher element within a conventional waveguide assembly. This drilled hole is 0.38 inches deep and is tapped to accept a 6–32 stainless steel screw. The long member of the waveguide launcher element has a hole drilled into the end therein to mate with the center pin of a coaxial transmission line connector. This hole is 0.125 inches in diameter and is 0.38 inches deep. The long member of the waveguide element which is shown in FIG. 1 may have a length of 2.485 inches overall. The short member of the waveguide L assembly has a length of 0.675 inches overall. The waveguide element has a square shape and each side is 0.250 inches long. The long member of the waveguide launcher element has its free end tapered and beveled to approximately 45° so as to have a 0.156 diameter circle at the end thereof. The drilled tapped hole in the short member is located 2.350 inches from the long end of the longitudinal member. The material from which the waveguide launcher element is fashioned in CDA copper alloy No. 863 (AMS 4862).

Figure 2:
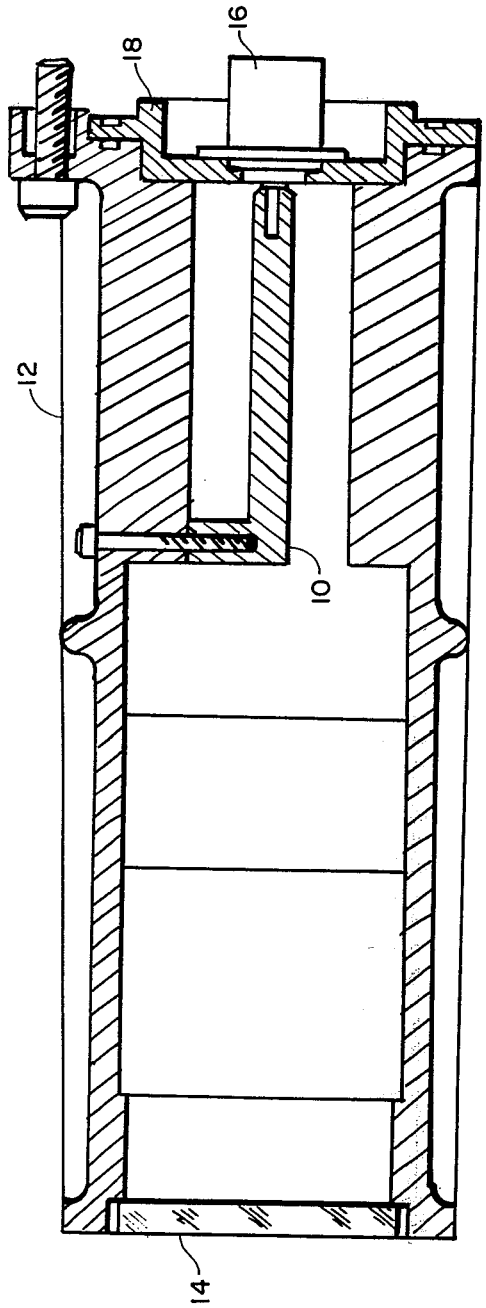
FIG. 2 is a sectional view of the waveguide launcher element positioned in a rectangular waveguide.

Turning now to FIG. 2, there is shown in section a conventional rectangular waveguide assembly 12 containing the waveguide element 10 of FIG. 1 therein. There is shown beryllium oxide (BeO) window 14 at one end of the waveguide assembly. The BeO window 14 is fashioned from material which connects 99.5 percent beryllium oxide and has a thickness of 0.99 ± 0.003. The flexual strength of the BeO window is 32,000 psi minimum and its compressive strength is 200,000 psi minimum. The average dielectric constant $K_o$ of the BeO window is 6.55 at 25° centigrade and at 1.3 Ghz. The BeO window is rectangular in shape and has the dimensions of 3.720 by 1.950. A suitable sealing compound is utilized all around the window to maintain it in its position within the rectangular waveguide and to provide a seal therefor.

There is shown at the opposite end of the waveguide assembly a coaxial connector 16 which is a UG58A/U connector. The coaxial connector 16 is mounted on a guide 18 which is attached to the waveguide. An O ring is mounted around the guide to provide a positive seal between the guide 18 assembly and the waveguide. The waveguide launcher element is shown mounted within the waveguide assembly with its longitudinal axis aligned with the center pin of the coaxial connector. The waveguide launcher element has one end soldered to the pin of the coaxial connector. The other end of the waveguide launcher element is fastened to the waveguide wall by a stainless steel hexagonal socket cap screw.

It may be seen from FIG. 2 that an antenna element is formed which comprises a rectangular waveguide main body, a BeO window, and a coax to waveguide launcher assembly. It may also be seen from FIG. 2 that the waveguide launcher element has a unique feature of its short depth intrusion into the waveguide main body to provide the desired match between the coax connector and free space. This match is achieved by configuring the coax to waveguide launcher element as a matching element as well as an adapter between the coaxial transmission line connector and waveguide section. The window and inductive iris combination at the aperture is tuned for match at midband and presents a significant mismatch at the band edges. The coax to waveguide launcher element is configured such that it is tuned for a match at midband and that the combination of the aperture and the launcher element is also matched at the band edges. This particular configuration of the waveguide launcher apparatus allows a match to be achieved over the desired bandwidth, in the present case 10 percent about the center frequency.

The waveguide launcher element is designed to operate in the L band with a band width of ± 5 percent. The launcher element dimensions are directly scaled in proportion to the wavelength of the center frequency of operation. Therefore, if the center frequency is doubled, the launcher element dimensions are halved in order to maintain the desired match.

Although the invention has been described with reference to a particular embodiment, it will be understood to those skilled in the art that the invention is capable of a variety of alternative embodiments within the spirit and scope of the appended claims.

What is claimed is:

1. A short depth hardened waveguide launcher apparatus comprising in combination:

means forming a waveguide cavity having a first and second end, said first end having a coaxial connector mounted thereon, said coaxial connector having a center conductor extending within said waveguide cavity, said second end having a window mounted therein, said waveguide cavity comprising a first and second waveguide cavity, said first waveguide cavity being smaller than said second waveguide cavity, said first waveguide cavity being positioned at said first end, and a waveguide launcher means mounted within said waveguide cavity, said waveguide launcher means being equidistantly positioned within said first waveguide cavity, said first waveguide cavity having a cavity length equal to the horizontal length of said waveguide launcher means, said waveguide launcher means being connected to center conductor of said coaxial connector said waveguide launcher means being vertically disposed within said first waveguide cavity, said center conductor of said waveguide launcher means in combination with said first cavity providing the desired match between said coax connector and free space.

2. A short depth hardened waveguide launcher apparatus as described in claim 1 wherein said waveguide launcher means comprises an L-shaped element having a first and second member, said first member having a length greater than said second member, said first member being axially with and connected to said center conductor of said coaxial connector, said second member being mounted to said waveguide cavity, said first and second members being joined at a common end.

3. A short depth hardened waveguide launcher apparatus as described in claim 2 wherein said L-shaped element has a short intrusion profile into said waveguide cavity.

4. A short depth hardened waveguide launcher apparatus as described in claim 2 wherein said window comprises a beryllium oxide window having an average dielectric constant, $K_o$, equal to 6.55 to 6.75 at 25°C and 1.3 GHz.

5. A short depth hardened waveguide launcher apparatus as described in claim 4 wherein said beryllium oxide window forms an aperture which is tuned for match at midband and presents a mismatch at the band edges.

6. A short depth hardened waveguide launcher apparatus as described in claim 5 wherein said waveguide launcher apparatus dimensions are scaled proportional to the wavelength of the center frequency of operation.

7. A short depth hardened waveguide launcher apparatus as described in claim 6 wherein said first and second members are rectangular in shape.

* * * * *